United States Patent [19]

Theodore et al.

[11] 4,029,572

[45] June 14, 1977

[54] AIR DRUM WITH DRYING MEANS

[75] Inventors: Michael J. Theodore, Weston, Mass.; Malcolm M. Paterson, Atkinson, N.H.; William J. Paxson, Cedar Rapids, Iowa

[73] Assignee: Raytheon Company, Lexington, Mass.

[22] Filed: Oct. 3, 1975

[21] Appl. No.: 619,414

[52] U.S. Cl. ..... 209/11; 209/152; 34/132; 432/112

[51] Int. Cl.[2] ..... B07B 4/06

[58] Field of Search ..... 209/11, 152, 473, 482; 432/112, 226; 34/119, 124, 108, 132, 133, 135, 137

[56] References Cited

UNITED STATES PATENTS

| | | | |
|---|---|---|---|
| 3,174,228 | 3/1965 | Smith | 34/119 X |
| 3,741,863 | 6/1973 | Brooks | 162/4 |
| 3,804,249 | 4/1974 | Gibbons et al. | 209/482 X |
| 3,814,240 | 6/1974 | Laundrie | 209/11 |

*Primary Examiner*—Frank W. Lutter
*Assistant Examiner*—Ralph J. Hill
*Attorney, Agent, or Firm*—Harold A. Murphy; Joseph D. Pannone; John T. Meaney

[57] ABSTRACT

A rotary drum air classifier apparatus for separating light and heavy materials introduced into the drum by conveyor means, means for producing a flow of air at relatively high velocity through the drum for entraining light materials, heating means encircling the drum for radiatively heating the drum and drying materials therein during the separation process, and means at one end of the drum for heating air as it enters the drum for further assisting in the drying process.

2 Claims, 5 Drawing Figures

FIG. 2
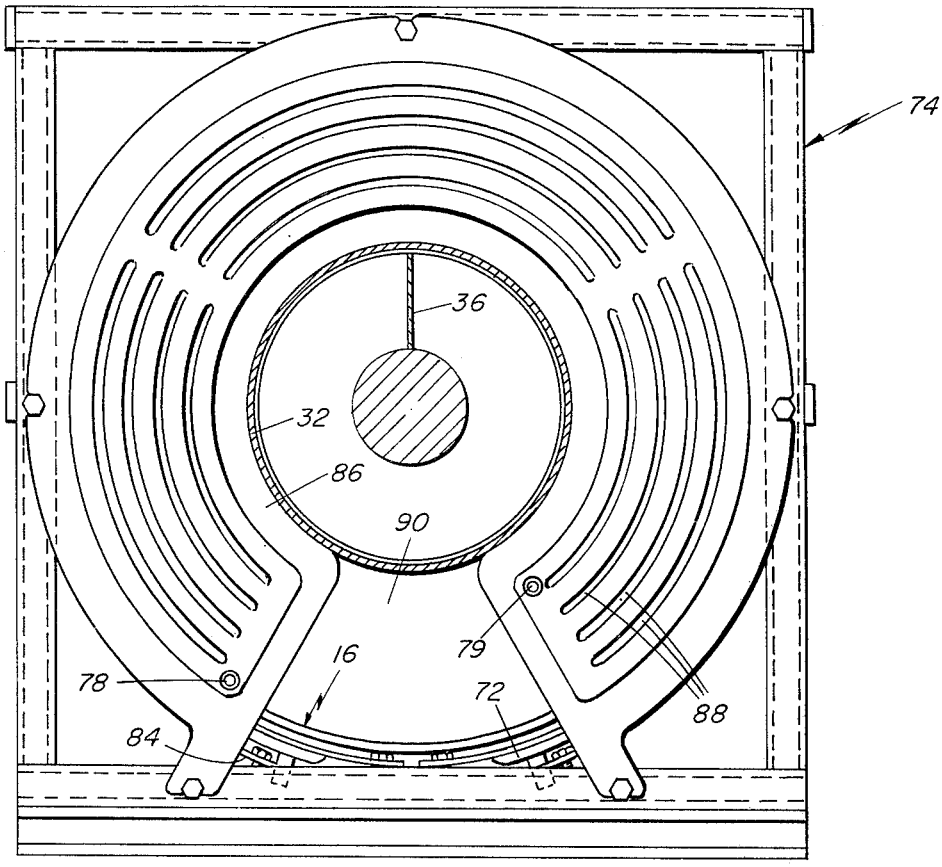
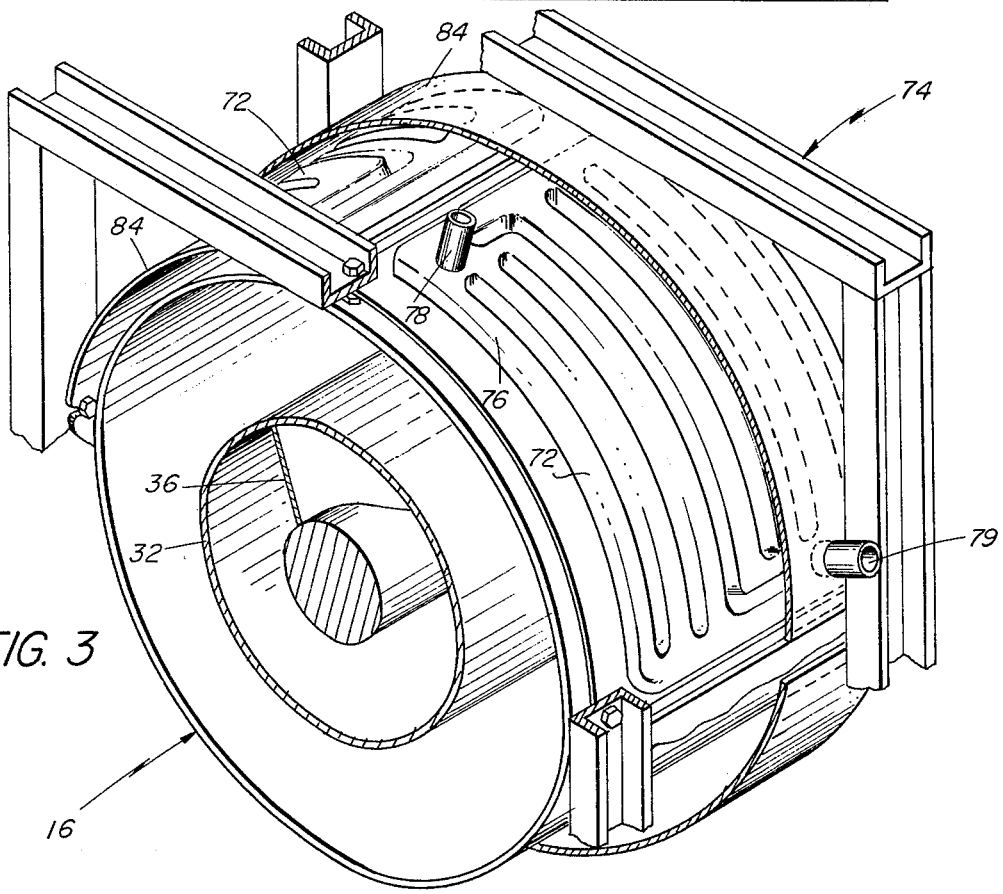
FIG. 3

AIR DRUM WITH DRYING MEANS

BACKGROUND OF THE INVENTION

In known air classification systems for receiving mixed materials and separating them into respective groups of light and heavy materials there is employed a rotary drum air classifier. The materials being separated, such as municipal waste for example, may include only items of a dry nature but often include such items as garbage or the like which contains considerable amounts of water.

The classifying apparatus includes conveyor means for depositing the mixed unclassified materials within the drum at a selected point along the length of the drum. The drum is inclined at an angle, such as 10° for example, to the horizontal and means is provided for rotating the drum about its longitudinal axis. The materials are deposited in the drum while the drum is being rotated and a stream of air is simultaneously directed at relatively high velocity into the lower end of the drum so as to entrain light materials and carry them out the upper end of the drum to additional processing apparatus.

The drum is provided internally with longitudinally extending vanes or lifters which, as the drum rotates, causes the heavy materials to be continuously raised and dropped within the drum so that, because of the inclination of the drum, the heavy materials will eventually work their way toward and out the lower end of the drum in the known manner. It will be apparent that light materials not initially entrained in the air stream when the materials fall from the load conveyor will be eventually separated from the heavy materials as the tumbling process continues.

It is known that the inclusion of any substantial amounts of moisture in the materials not only will cause sticking together of materials and adhesion of wet materials to the walls of the drum, resulting in possible jamming and clogging of the apparatus, but also will cause some possibly substantial amounts of light materials to be separated out as heavy materials because of the added weight caused by the water content. Separate driers for removing the moisture from the materials before they are deposited in the drum is a conventional manner of correcting the situation. However, this entails added expense and the addition of undesirable space-consuming apparatus into the system.

SUMMARY OF THE INVENTION

The foregoing and other objections to known classifier apparatus are overcome or eliminated in the present invention by the provision of heating apparatus which is associated directly with the rotary drum for heating the drum by radiation whereby the drum may thereafter cause drying of materials within, partly by conduction but primarily by convection.

In accordance with this invention the drum is encircled by a frame which carries one or more heating devices such as plate coils which enclose a selected substantial portion of the drums's surface in spaced relation with it. The heating coils are covered by a heat-reflecting jacket so as to concentrate the heat upon the drum surface. Steam, hot water or other heat-producing fluid is made to flow through the coils to supply the heat for the drum walls.

The major portion of the lower end of the drum is closed by a substantially circular plate coil which is provided with a number of slots or apertures through which the air stream is drawn into the drum. This end coil provides means for heating the incoming air to assist the enclosing coils in the heating of the interior of the drum.

BRIEF DESCRIPTION OF THE DRAWINGS

The above and other advantages of the invention will become apparent from the following description taken in connection with the accompanying drawings wherein:

FIG. 2 is an end view of the lower end of the drum of FIG. 1 showing an end plate coil in position of use;

FIG. 3 is an enlarged fragmentary isometric view of a portion of a plate coil, jacket and drum assembly;

DESCRIPTION OF THE PREFERRED EMBODIMENT

Figures 1, 4:
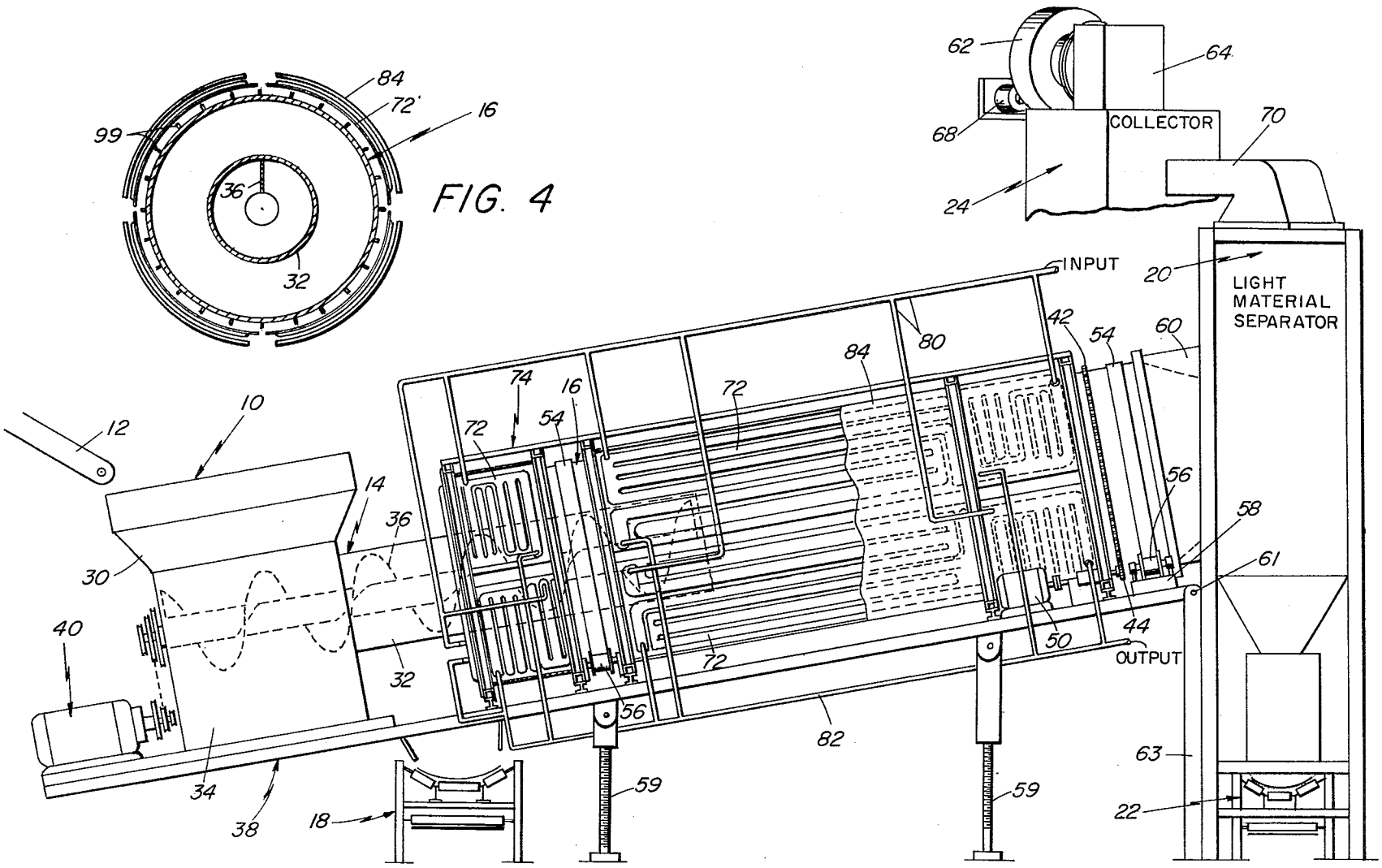
FIG. 1 is an elevational view showing a rotary drum air classifier embodying the invention.
FIG. 4 is a reduced sectional view through the drum and encircling heating apparatus showing particularly the turbulence creating projections on the outer surface of the drum.

Referring more particularly to the drawings wherein like characters of reference designate like parts throughout the several views, the apparatus shown in FIG. 1 includes a number of cooperating devices arranged to process and separate materials automatically in sequential fashion.

A feed hopper 10 receives shredded mixed materials from an adjacent conveyor 12 and directs it to a screw conveyor 14 which deposits it within a rotatable air drum classifier 16. The drum classifier separates the mixed materials into light and heavy materials in the known fashion of devices of this character. The drum is angled at a selected inclination, such as 10° for example, and air is caused to flow through it at high velocity. As mixed materials drop from the end of the screw conveyor onto the bottom of the drum wall, the heavy materials will be rotated upwardly with the drum to a point where they will fall to a lower point within the drum. This tumbling action is repeated until eventually the heavy materials fall out of the lower end of the drum onto a conveyor 18 which will carry them away for further processing or disposal.

The light materials will be entrained within the high velocity air stream and will be carried out the upper end of the drum 16 into a plenum chamber 20. In the plenum chamber 20 these light materials are further separated into light and medium fractions by controlling the velocity of the air stream within the chamber 20. The air stream from the drum 16 enters the plenum chamber 20 at a point in the lower regions thereof an exits at the top. Thus, by controlling the size of the chamber, and thereby the velocity of the air rising within it, the heavier of the materials entrained within the air stream will be permitted to fall by gravity to the bottom of the chamber for removal by suitable means such as a conveyor 22 for eventual reprocessing or disposal such as by incineration or other means.

The lighter fractions will continue to be entrained within the air stream and will be carried into one or more cyclone collectors 24. Such light fractions may serve many purposes and have been found particularly suitable for use as fuel. They are removed from the cyclone by a screw conveyor (not shown) or the like to a suitable belt conveyor which will then carry them to selected supply or disposal areas.

The feed hopper 10 is provided with a bucket portion 30 at its upper end into which the mixed materials are deposited by the conveyor 12. These mixed materials have previously been shredded so that they comprise a mixture of material elements not exceeding about 12 inches in size, for example.

A feed duct or conduit 32 extends from the base 34 of the feed hopper 10 into the adjacent end of the drum 16. Within the duct 32 is a feed screw 36, one end of which is mounted in the hopper base 34 to receive the materials from bucket 30. Hopper 10 is mounted upon a suitable base or platform 38 which also supports the drum 16, as will be described.

Screw 36 is driven by a motor and chain drive 40 so that the mixed materials will be moved along duct 32 into the drum interior. The duct is preferably closed at its end within the drum, and is apertured at the bottom adjacent the end wall so that the materials will fall through the aperture onto the drum wall preferably at a point within the first third of the length of the drum.

At a selected point along its length the drum is provided with a fixed circumferential sprocket wheel or girth gear 42 which meshes with a chain link drive belt 44 carried by a pair of smaller sprocket wheels. One sprocket wheel is rotatably mounted on one end of a reduction gear box which is interconnected with drive motor 50 on platform 38 whereby rotation of the drum is accomplished. The second small sprocket wheel (not shown) is supported in any suitable manner on the opposite side of platform 38 so that the drive belt is held constantly in mesh with the sprocket wheel 42.

The platform 38 and consequently the drum 16 thereon is angled to a selected inclination, such as 10° for example. To prevent longitudinal displacement of the drum there are provided two fixed restraining rings or collars 54 extending around the circumference of the drum and spaced from respective ends thereof. Each ring 54 engages a respective roller 56 mounted by suitable bearings in a support 58 carried by the platform 38. Flanges on the sides of the rollers 56 prevent longitudinal movement of the drum as it is rotated.

As shown in FIG. 1, the angle of inclination of the drum 16 may be altered to vary the velocity of the air flowing through the drum and to thereby vary the ratio of lights to heavies being separated within the drum. Such changing of the angle of inclination of the drum may be accomplished by means of jackposts 59, for example, which are suitably mounted beneath the drum 16 and attached to it.

The upper end of the drum is preferably tapered and extends into a suitable sealing ring 60 which is fixed over an inlet opening in the adjacent side wall of the plenum chamber 20.

It is important, however, to retain the upper end of the drum constantly within the sealing ring 60 in the plenum chamber 20. Therefore, the upper end of the drum is pivoted as by a suitable bearing and shaft arrangement 61 carried preferably by the adjacent end of the platform 38 and rotatably mounted at the upper ends of fixed supports or standards 63. Thus, the platform 38 can be raised and lowered by manipulation of the jackposts 59, causing the drum to be angled about the axis of the pivotal connection 61, with the sealing ring 60 being constantly retained in assembled relation with the adjacent end of the drum.

Air at high velocity is forced through the drum 16 by means of a fan or blower 62 which is mounted in any suitable fixed location and operatively connected to an exhaust duct 64 at the upper end of the cyclone 24. The blower is operated by a motor 68 through suitable driving means so as to rotate in a manner which will suction air upwardly out of the cyclone. Such air is initially drawn into the cyclone through a duct 70 from the upper end of the plenum chamber 20.

Thus, air is also drawn upwardly out of the plenum chamber 20 and simultaneously into the plenum chamber from the rotary drum 16.

In the construction and operation of an air drum classifier of this sort, there are provided a series of spaced longitudinally extending ribs or vanes (not shown) on the inner wall of the drum 16 which function as lifters to raise the heavy materials, as the drum rotates, to a height from which they may be dropped again to the bottom of the drum. It will be understood that since the drum is inclined the heavy materials after each lift will be dropped nearer the lower end of the drum. Therefore, continued rotation of the drum and consequent tumbling of the heavy materials will move these materials toward the lower end of the drum until they eventually fall out of the drum onto conveyor 18. A considerable amount of the light materials emanating from the end portion of the feed duct 32 will be entrained in the high velocity air stream as the materials drop from the conveyor onto the drum wall and will be drawn into the plenum chamber 20. However, some small amounts of light materials will be mixed with the heavy materials falling onto the drum wall. These light materials will, of course, also be raised by the lifters and will eventually be removed by the air stream during the repetitive tumbling as the drum is rotated. Consequently, substantially all of the light materials will eventually be separated and drawn into the plenum chamber 20.

However, it has been found that the materials deposited in the drum 16 from the inner end of screw conveyor 14 will often contain various amounts of moisture. This moisture and the pressure exerted upon the materials by the feed screw 36 will cause the materials to adhere together and may form undesirable accumulations, masses or accretions containing commingled heavy and light materials which may continue to be adhered together during rotation of the drum and tumbling of the materials. At times this can even cause clogging of the apparatus. Consequently, inefficient separation of the materials results.

This problem is overcome in the present invention by the provision of means for heating the interior of the drum to a temperature which will dry the materials sufficiently for proper separation within the drum. The heating means according to this invention comprises heating elements in the form of plate coils 72 which are strategically located in at least partial surrounding relation to the exterior surface of the drum, and a slotted plate coil 86 partially closing the lower end of the drum. The encircling plate coils 72 are supported by a frame 74 in slightly spaced relation with the drum 16 so as not to interfere with the rotation of the drum.

Any number of plate coils 72 may be used and any selected portion of the drum 16 may be covered. In FIG. 1 substantially all of the exterior surface of the drum is covered by plate coils except the areas occupied by the rotation mechanism 42–44 and the displacement prevention rings 54. It is desirable, however, that the coils cover at least the space within the drum from the inner end of conveyor 14 to nearly the upper end of the drum.

The plate coils 72 are made in any conventional manner by laminating together, as by welding, two plates one or both of which are provided with a continuous recess 76 the ends of which are shown in FIG. 3 as being located near diametrically opposite corners. Couplings 78 and 79 are fitted into the ends of the recesses so that steam or hot water may be forced through one coupling, into and through the winding recess and out the other coupling. The windings or turns of the recess are usually relatively close spaced so that when the heated fluid is introduced the entire plate coil will soon become a broad source of radiant heat.

The input coupling 78 is connected by suitable pipes 80 to any suitable source of heat-producing fluid such as a boiler (not shown) from which the fluid is pumped through the pipes to the various plate coils. The second or outlet coupling 79 is connected by pipes 82 to any suitable collector (not shown) which might be the boiler or other means initially used to supply the fluid.

The plate coils 72 are covered on their outer sides by a heat-reflecting jacket 84 which is preferably of metal with a polished or otherwise reflective surface. Thus, the heat which initially is radiated outwardly from the plate coils 72 will be reflected back toward the drum.

The lower end of the drum 16 is partially closed by a circular plate coil 86 (FIG. 2) which has a central aperture fitted around the conveyor housing 32. This circular plate coil 86 is formed similarly to plate coils 72 but is additionally provided with a number of through slots 88 which are sufficiently large enough to allow high velocity air flow through the coil. Coil 86 is open at its lower end to provide an opening 90 through which heavy materials may slide out of the lower end of the drum.

The circular plate coil 86 is secured by bolts or the like preferably to the same frame 74 which supports the side plate coils 72, and is also provided with inlet and output couplings connected respectively to pipes 80 and 82 so that the heat-producing fluid may be circulated through the circular plate coil.

Thus, it will be understood that wet materials falling from the inner end of conveyor 14 will immediately be subjected to the heat from the walls of the drum and also to the heat of the air coming through the drum after passing through the circular plate coil. Moisture will be removed by the air flow from the materials while the materials are still in the drum.

Figure 5:
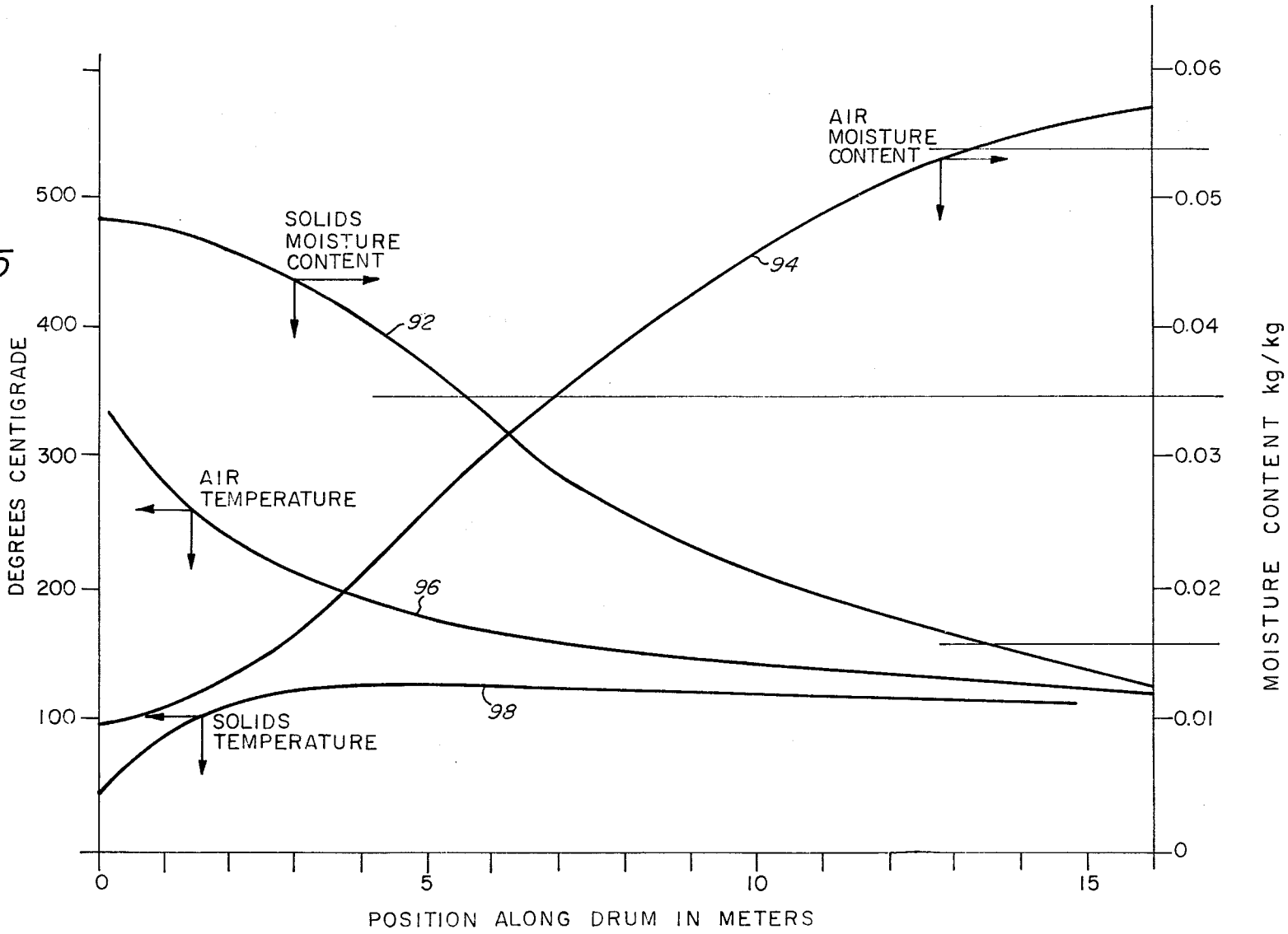
FIG. 5 is a diagram illustrating the heating and drying effect produced by the invention.

Referring to FIG. 5, curve 92 shows the reduction in moisture content which may be expected in solid materials passing through the drum. Curve 94 illustrates how this moisture is removed by the air stream flowing through the drum.

Curve 96 illustrates how the temperature of the heated air flow coming through the circular plate coil becomes somewhat lowered after coming into contact with the materials in the drum, and curve 98 shows that the materials acquire some rise in temperature within the drum, all of which aids leads in the efficient removal of moisture in accordance with the invention.

It will be understood that the interior of the drum 16 may be maintained at any selected and desired temperature which will be suitable for drying the particular materials being processed. It has been found that municipal waste can be dried sufficiently to permit proper and efficient lights and heavies separation if the drum's interior is held at a temperature of approximately 190° F, for example.

It has also been found that more efficient heating of the drum will occur if the outer surface of the drum in the areas opposite the plate coils 72 is provided with projections 99 for creating turbulence in the air in the space between the drum and the plate coils as the drum rotates. This turbulence increases efficiency in the transfer of heat to the drum by increasing the rate at which molecules travel in this region. The projections 99 may be of any desired configuration such as fins, rings, pins, modules, or the like, and may be disposed in an ordered plan or pattern or in a disordered array, as desired.

It is to be understood that while a particular apparatus is disclosed including a rotary drum separator, other apparatus employing a rotary drum separator may be used. The apparatus may be used to handle materials of relatively large size or the materials may be small, even granular.

Accordingly, it will be apparent from the foregoing that all of the objectives of this invention have been achieved by the rotary drum separator shown and described. It is to be understood that various modifications and changes in the apparatus shown and described may be made by those skilled in the art without departing from the spirit of the invention as expressed in the accompanying claims. Therefore, all matter shown and described is to be interpreted as illustrative and not in a limiting sense.

What is claimed is:

1. An air classifier system comprising a drum, means for depositing mixed materials to be separated into the drum, means for directing a flow of air at relatively high velocity into one end and through the drum to entrain and carry light materials out the opposite end of the drum, means for removing moisture from the materials in the drum comprising plate coils disposed in at least partially encircling spaced relation to the outer surface of the drum for heating same, means for supplying heat-producing fluid to said plate coils for circulation therethrough, and means for removing fluid from the coil after circulation, and heat reflecting means covering the outer side of said plate coils for reflecting heat toward the drum, the outer surface of the drum being provided in areas opposite said plate coils with projections for creating turbulence in the air in the space between the drum and coils.

2. An air classifier system comprising a drum, means for depositing mixed materials to be separated into the drum, means for directing a flow of air at relatively high velocity into one end and through the drum to entrain and carry light materials out the opposite end of the drum, and means for removing moisture from the materials in the drum comprising plate coils disposed in at least partially encircling spaced relation to the outer surface of the drum for heating the drum, an additional plate coil in at least partially closing relation to said one end of the drum for heating said air flow entering said one end of the drum, said additional plate coil having slots therethrough through which said air flow passes, means for supplying hot fluid to said plate coils for circulation therethrough, and means for removing fluid from the coil after circulation, the outer surface of the drum being provided in areas opposite said plate coils with projections for creating turbulence in the air in the space between the drum and coils.

* * * * *